US008584674B1

(12) United States Patent
Poliard

(10) Patent No.: US 8,584,674 B1
(45) Date of Patent: Nov. 19, 2013

(54) OXYGEN DELIVERY SYSTEM FOR MOTOR VEHICLES

(76) Inventor: Samuel Poliard, Miami, FL (US)

( * ) Notice: Subject to any disclaimer, the term of this patent is extended or adjusted under 35 U.S.C. 154(b) by 817 days.

(21) Appl. No.: 12/454,804

(22) Filed: May 22, 2009

Related U.S. Application Data

(60) Provisional application No. 61/128,410, filed on May 22, 2008.

(51) Int. Cl.
*A62B 7/00* (2006.01)

(52) U.S. Cl.
USPC ..... 128/204.29; 128/204.21; 128/206.27

(58) Field of Classification Search
USPC ..... 128/204.21, 204.29, 205.24, 205.25, 128/206.27
See application file for complete search history.

(56) References Cited

U.S. PATENT DOCUMENTS

| | | | | |
|---|---|---|---|---|
| 2,931,355 | A * | 4/1960 | Miller et al. | 128/204.29 |
| 2,934,293 | A * | 4/1960 | Boehme et al. | 244/118.5 |
| 3,503,394 | A * | 3/1970 | Hotz et al. | 128/206.27 |
| 3,720,207 | A * | 3/1973 | Matheny et al. | 128/202.14 |
| 4,154,237 | A * | 5/1979 | Courter | 128/206.27 |
| 4,428,372 | A | 1/1984 | Beysel et al. | |
| 4,508,700 | A | 4/1985 | Hoshiko | |
| 5,809,999 | A | 9/1998 | Lang | |
| 6,279,571 | B1 | 8/2001 | Meckes | |
| 6,336,667 | B1 * | 1/2002 | Ford et al. | 292/25 |
| 6,701,923 | B2 | 3/2004 | Cazenave et al. | |
| 6,712,886 | B2 | 3/2004 | Kim | |
| 7,375,625 | B2 * | 5/2008 | Fujioka | 340/445 |

* cited by examiner

*Primary Examiner* — Lynne Anderson
(74) *Attorney, Agent, or Firm* — Robert C. Montgomery; Montgomery Patent & Design

(57) ABSTRACT

The invention discloses a safety mechanical system by which emergency oxygen is delivered to motor vehicle occupants during an accidental water submersion of the vehicle. The system utilizes an oxygen filled tank located in the trunk, or another concealed area. The tank is connected to a manifold system with an automatic valve. The valve is activated and opened when a series of sensors detects that the vehicle is partially or fully submerged. Upon such detection, the valve is opened and oxygen is delivered through the manifold, then to a series of flexible tubes to a set of drop down masks that automatically deploy from an overhead console in the vehicle's headliner. The drop down assembly is of an adequate length of coiled hose similar to that found on a commercial airliner for oxygen use during sudden decompression. With such an installed system, vehicle occupants are provided with a mask and oxygen until they can be rescued or escape on their own.

9 Claims, 8 Drawing Sheets

OXYGEN DELIVERY SYSTEM FOR MOTOR VEHICLES

RELATED APPLICATIONS

The present invention was first described in and claims the benefit of U.S. Provisional Application No. 61/128,410, filed May 22, 2008, the entire disclosures of which are incorporated herein by reference.

FIELD OF THE INVENTION

The present invention relates generally to supplemental oxygen delivery systems and, more particularly, to a supplemental oxygen delivery system that is installed into a motor vehicle and provides oxygen in emergency situations.

BACKGROUND OF THE INVENTION

Various types of emergency breathing apparatuses are used in emergency situations. Typically these breathing apparatuses are used in modern mass transit systems, emergency vehicles, and by emergency first responders and are intended to protect a user from harmful airborne particles or supplement a lack of breathable oxygen. Some examples are U.S. Pat. Nos. 6,279,571, issued in the name of Meckes, which describes an emergency breathing apparatus comprising a hood that is worn by a user in an environment where there is a fire or other contamination and 5,809,999, issued in the name of Lang, which describes a method and apparatus for supplying breathable gas in emergency oxygen systems, especially in an aircraft. Various other attempts to provide breathable oxygen for emergency uses include: U.S. Pat. No. 4,428,372, issued in the name of Beysel et al., which describes a process and apparatus for providing breathing gas; 4,508,700, issued in the name of Hoshiko, which describes a method of generating oxygen for emergency use; and 6,701,923, issued in the name of Cazenave et al., which describes a process and installation for the distribution of air enriched in oxygen to passengers of an aircraft. These attempts however have certain disadvantages, including the chance of combustion due to the use of enriched oxygen and the complexity of installation and utilization which often restricts the versatility of the solution to use with pressurized environments and other more common emergency situations are not addressed.

All too often we hear or read about a motor vehicle that travels off of a roadway and ends up submerged in a lake, stream, pond, or the like. Most times, such accidents occur from general confusion, poor visibility, unknown surroundings and the like. As such, most drivers are awake, not injured, and in control of an operational vehicle when all of a sudden they find themselves in rapidly rising water. However, doors may become stuck, windows may become non-operational and people die quickly even if a rescue team is immediately dispatched due to the simple matter of the vehicle occupants drowning. A few minutes of air make all the difference for a rescue team or even the vehicle occupants themselves who may now have time to get a door open or a window broken out. While various vehicle air purification and recirculation systems exist, they do not address use in emergency situations. U.S. Pat. No. 6,712,886, issued in the name of Kim, describes an air purification device for an automobile with oxygen-supplying function which air is collected, purified, and enriched with oxygen before being resupplied to the vehicle.

While these devices fulfill their respective, particular objectives, each of these references suffers from one (1) or more of the aforementioned disadvantages. Accordingly, a need exists for a means by which occupants of a submerged vehicle can be provided with a source of oxygen during an accidental submersion to allow for rescue. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to simply and effectively provide occupants of a submerged vehicle an automatic source of oxygen during an accidental submersion which will increase survivability and assist in rescue and thus, the object of the present invention is to solve the aforementioned disadvantages.

To achieve the above objectives, it is an object of the present invention to provide a self-contained breathing system for motor vehicles that provides a means for supplying a source of oxygen or similar gaseous mixture to a user during an accidental submersion of a motor vehicle, thereby enabling the survivability and rescue of occupants trapped inside.

Another object of the self-contained breathing system for motor vehicles is to provide a system comprising a plurality of breathing masks, a plurality of coiled flexible tubing, a manifold, a plurality of solenoid valves, a central channel enclosure, an electromagnet release mechanism, a control switch, and other electrical and mechanical components.

Yet still another object of the self-contained breathing system for motor vehicles is to provide a system that provides a supply of gaseous mixture to vehicle occupants whom possess respiratory conditions that require the utilization of oxygen to breath.

Yet still another object of the self-contained breathing system for motor vehicles is to provide a system that would be provided as standard or optional equipment on new motor vehicles or as an aftermarket kit for addition to an existing motor vehicle.

Yet still another object of the self-contained breathing system for motor vehicles is to provide a method of utilizing the device which provides an increased level of safety for motor vehicle occupants in the event of the typically tragic accidental submersion. Such a method may further include the steps of: providing and installing a central channel enclosure at a desired location within the motor vehicle; providing and routing tubing throughout the motor vehicle; providing and connecting a plurality of breathing masks to the tubing; providing and charging a tank with the gaseous mixture; providing and connecting a ball valve and a gate valve to the tank respectively; closing the ball valve and opening the gate valve; fastening the tank to a desired location in the motor vehicle; providing and coupling a manifold to the tank; providing and connecting a plurality of valves to the manifold; connecting the tubing to the valves; providing and toggling a control switch to a desired operable position; and when the motor vehicle is submerged, automatically releasing the breathing masks and the tubing.

Further objects and advantages of the self-contained breathing system for motor vehicles will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
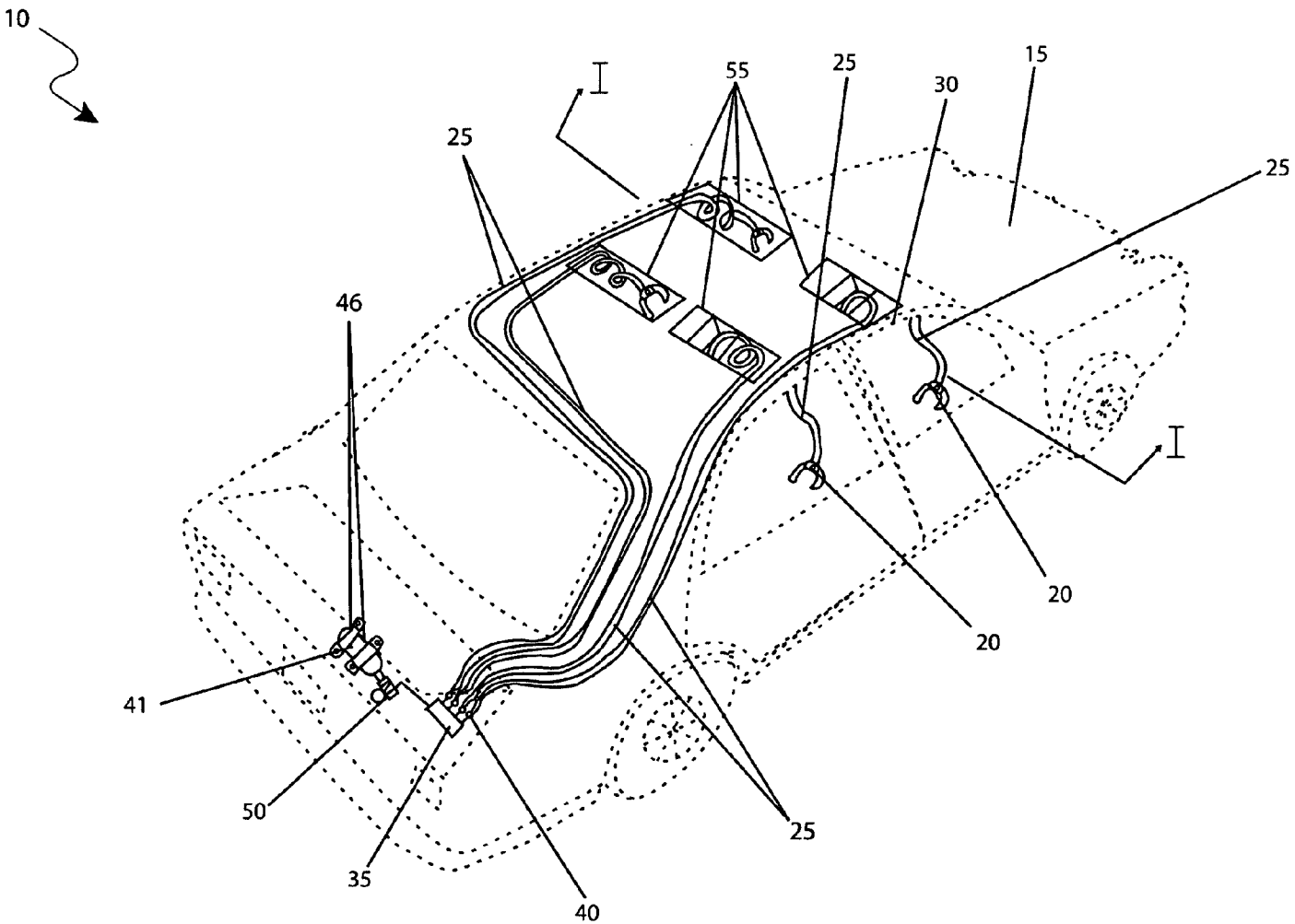
FIG. 1 is an environmental view of the self-contained breathing system for motor vehicles 10 depicting an installed state on a motor vehicle 15, according to the preferred embodiment of the present invention.

10 self-contained breathing system for motor vehicles
15 motor vehicle
20 breathing mask
21 aperture
22 gaseous mixture
25 coiled flexible tubing
30 roof
35 manifold
39 ball valve
40 solenoid valves
41 tank
42 gate valve
43 Schrader valve
44 regulator
45 gauge
46 bracket
47 bracket fastener
48 gas canister
49 T-fitting
55 central channel enclosure
56 enclosure fastener
60 spring-loaded doors
62 magnet
65 electromagnet release mechanism
70 hinges
75 control switch
76 electrical wiring
95 battery
100 pressure switch
105 moisture detection switch
110 relay coil
115 relay contacts
120 occupant

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a self-contained breathing system for motor vehicles (herein described as the "system") 10, which provides a means for supplying a source of oxygen or another similar gaseous mixture 22 during an accidental submersion of a motor vehicle 15, thereby allowing for the rescue of occupants 120 trapped therein. Said system 10 comprises a plurality of breathing masks 20, a plurality of coiled flexible tubing 25, a manifold 35, a plurality of solenoid valves 40, a central channel enclosure 55, an electromagnet release mechanism 65, a control switch 75, and other electrical and mechanical components. Said system 10 also may be provided to supply the gaseous mixture 22 to occupants 120 whom possess respiratory conditions which require the utilization of oxygen to breath. The system 10 would be provided as standard or optional equipment on new motor vehicles 15 or provided as an aftermarket kit for an addition to existing motor vehicles 15.

Referring now to FIG. 1, an environmental view of the system 10 depicting an installed state on a motor vehicle 15, according to the preferred embodiment of the present invention, is disclosed. A plurality of breathing masks 20, are provided for each seating positions in the motor vehicle 15, one (1) per seating position. As such, a typical vehicle 15 would be equipped with two (2) to eight (8), depending on vehicle 15 size. A larger number of breathing masks 20 such as for vans and busses could also be provided. The breathing masks 20 are supported from coiled flexible tubing 25 which is in turn supported from a roof 30 of the motor vehicle 15. Further disclosure of the supporting means and associated components will be described in greater detail herein below. Each section of coiled flexible tubing 25 terminates in a manifold 35 via an individual solenoid valve 40.

The manifold 35 and the solenoid valves 40 are mechanically interconnected to a tank 41 via coiled flexible tubing 25 and a ball valve 30. The manifold 35, solenoid valves 40, and tank 41 would be located in an accessible, but hidden location on the motor vehicle 15. FIG. 1 depicts said location as the trunk of the motor vehicle 15, but other locations can also be considered, and as such, should not be interpreted as a limiting factor of the present invention. As will be seen herein below, the breathing mask 20 along with the coiled flexible tubing 25 will drop into a usable condition as governed by an automatic mechanism should the motor vehicle 15 become submerged, or via a manual release as controlled by occupants 120 therein the motor vehicle 15. In such a manner, the system 10 can provide the gaseous mixture 22 in the case of accidental submersions.

The manifold 35 is a conventional device utilized to direct the gaseous mixture 22 through an inlet thereto a plurality of outlets. Each outlet is connected to a plurality of conventional solenoid valves 40 which are further connected to the coiled flexible tubing 25 and the inlet is connected to the tank 41 each use common tubing connectors. Said solenoid valve 40 is an electromechanical valve which is controlled with an electrical current; therefore, said solenoid valve 40 is interconnected to the battery 95 therewith conventional electrical wiring 76.

The coiled flexible tubing 25 is a conventional hollow plastic or rubber hose specifically utilized to carry air from the solenoid valves 40 to the breathing masks 20. Said coiled flexible tubing 25 is preferably ribbed or corrugated, thereby enabling said tubing 25 to bend while preventing twisting and cutting off flow of the gaseous mixture 22. Said coiled flexible tubing 22 would be routed discretely on an internal surface of the exterior vehicle 15 body panels as required by the make and model of said motor vehicle 15. A distal end portion of each tube 25 is connected to a breathing mask 20. Should egress outside of the vehicle 15 be obtained, the length of the coiled flexible tubing 25 in its uncoiled length is viewed as approximately fifty (50) feet to allow the occupants 120 to swim away from the motor vehicle 15 while still being afforded the use of the gaseous mixture 22.

Each breathing mask 20 provides an occupant 120 with a means to transfer the breathable gaseous mixture 22 to their lungs via the mouth portion of the occupant 120. Said breathing masks 20 are preferably fabricated from a material such as, but not limited to: rubber, plastic, or the like (also see FIG. 4).

Figure 7:
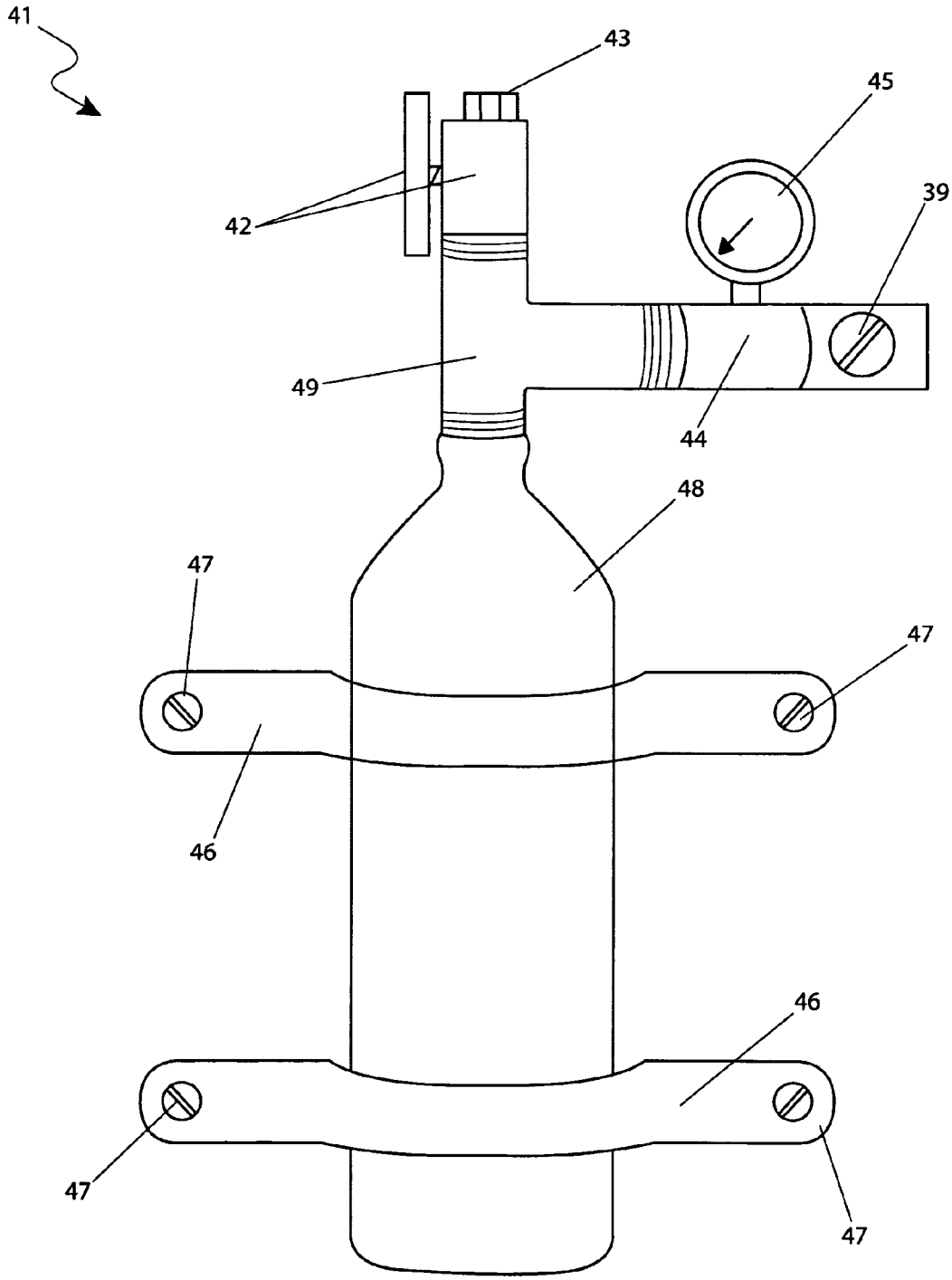
FIG. 7 is a front view of a tank 41, according to the preferred embodiment of the present invention; and, FIG. 8 is bottom view of the tank 41, according to the preferred embodiment of the present invention.
Figure 8:
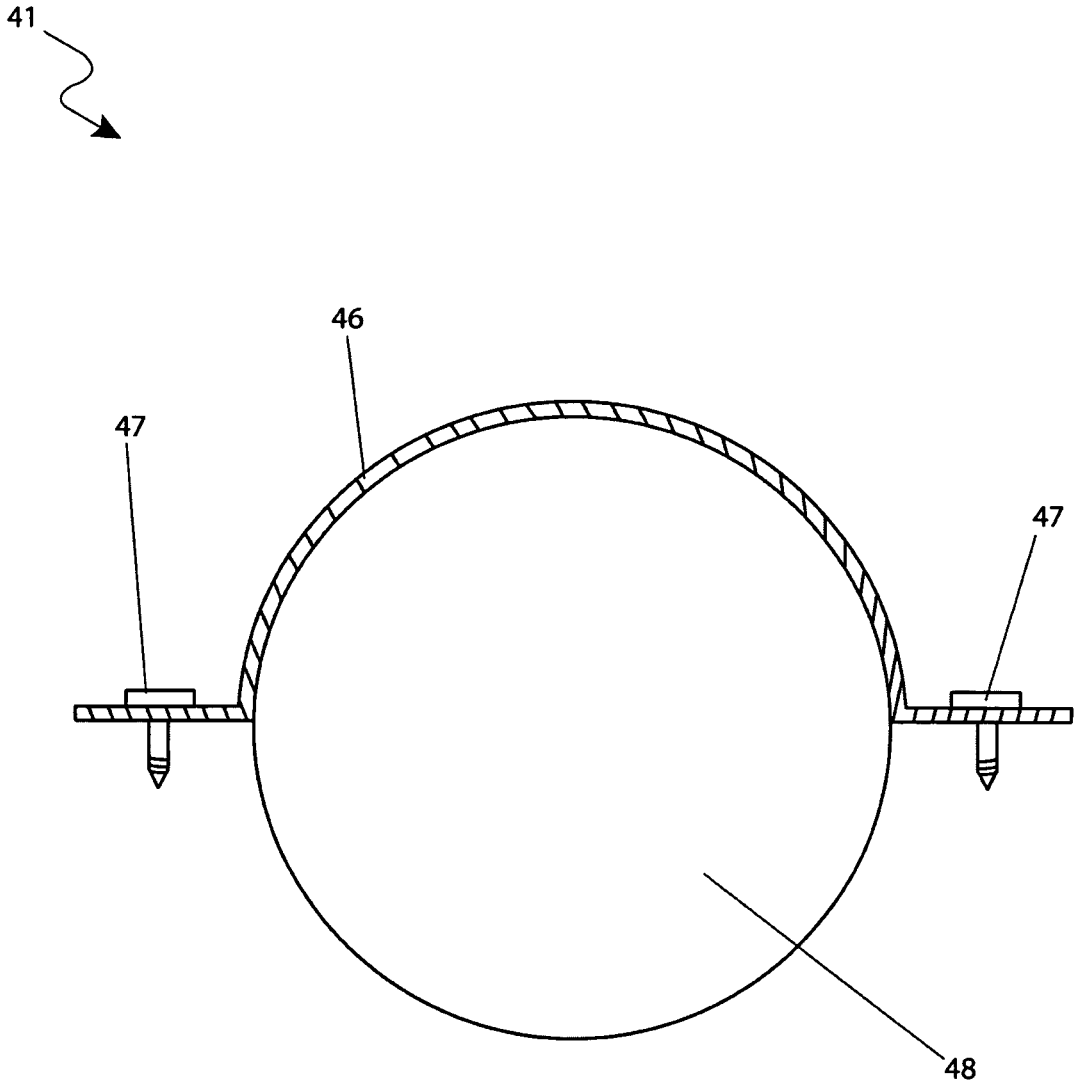

The tank 41 would be filled with a conventional breathable gaseous mixture 22 such as air, oxygen, or an air/oxygen mixture (also see FIGS. 7 and 8). Said tank 41 is similar to cylinders utilized for diving, scuba diving, or like which store and transport a breathable gaseous mixture 22. The capacity of the tank 41 provides an approximate usage time of twenty (20) minutes for all occupants 120. This time restraint is viewed as adequate for rescue by emergency personnel, and/or gives time for the occupants 120 to escape on their own through the motor vehicles 15 doors, windows, trunk, rear hatch or the like.

Figure 2:
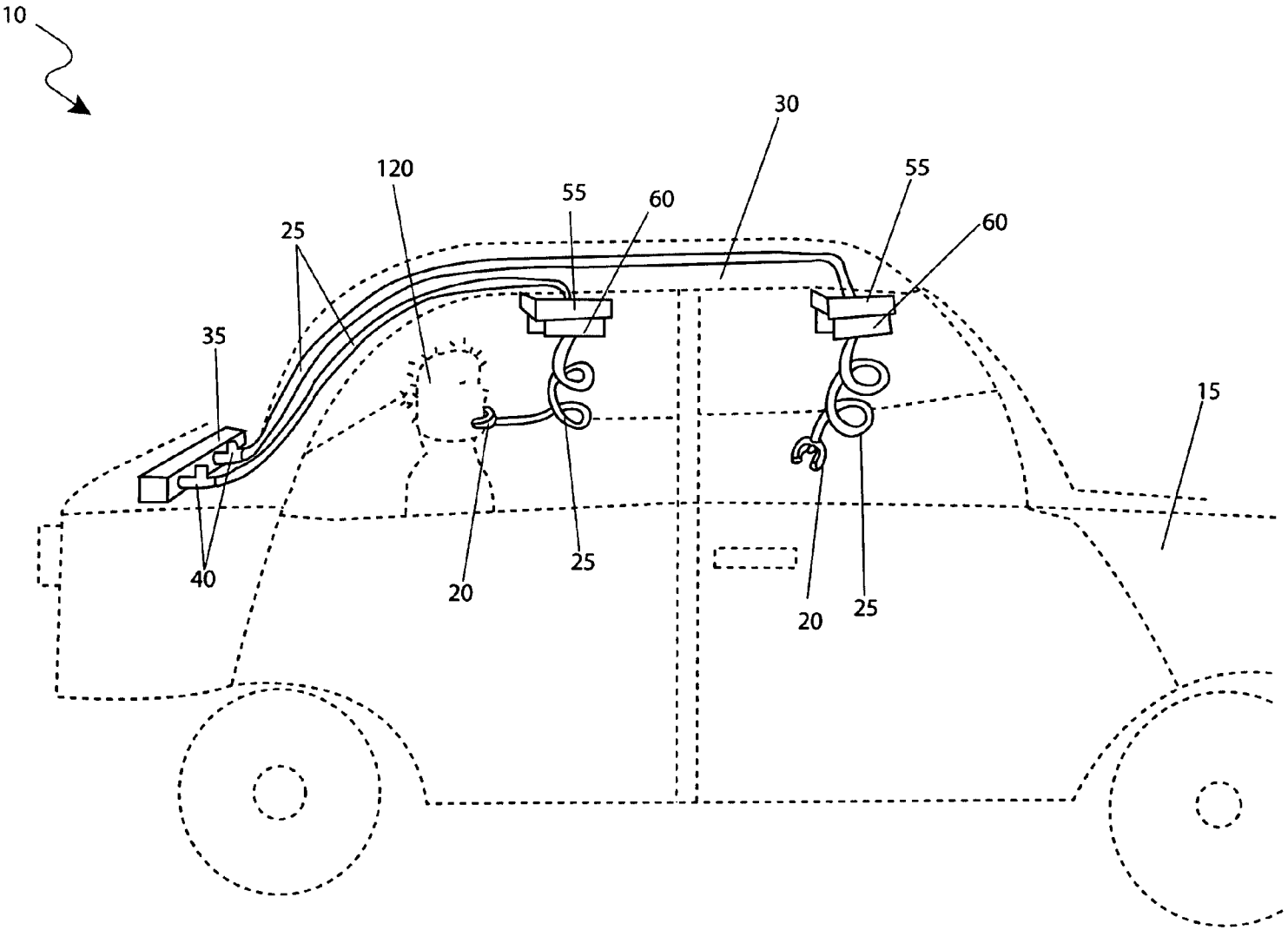
FIG. 2 is an environmental view of the central channel enclosure 55 depicting a deployed state, according to the preferred embodiment of the present invention.
Figure 3:
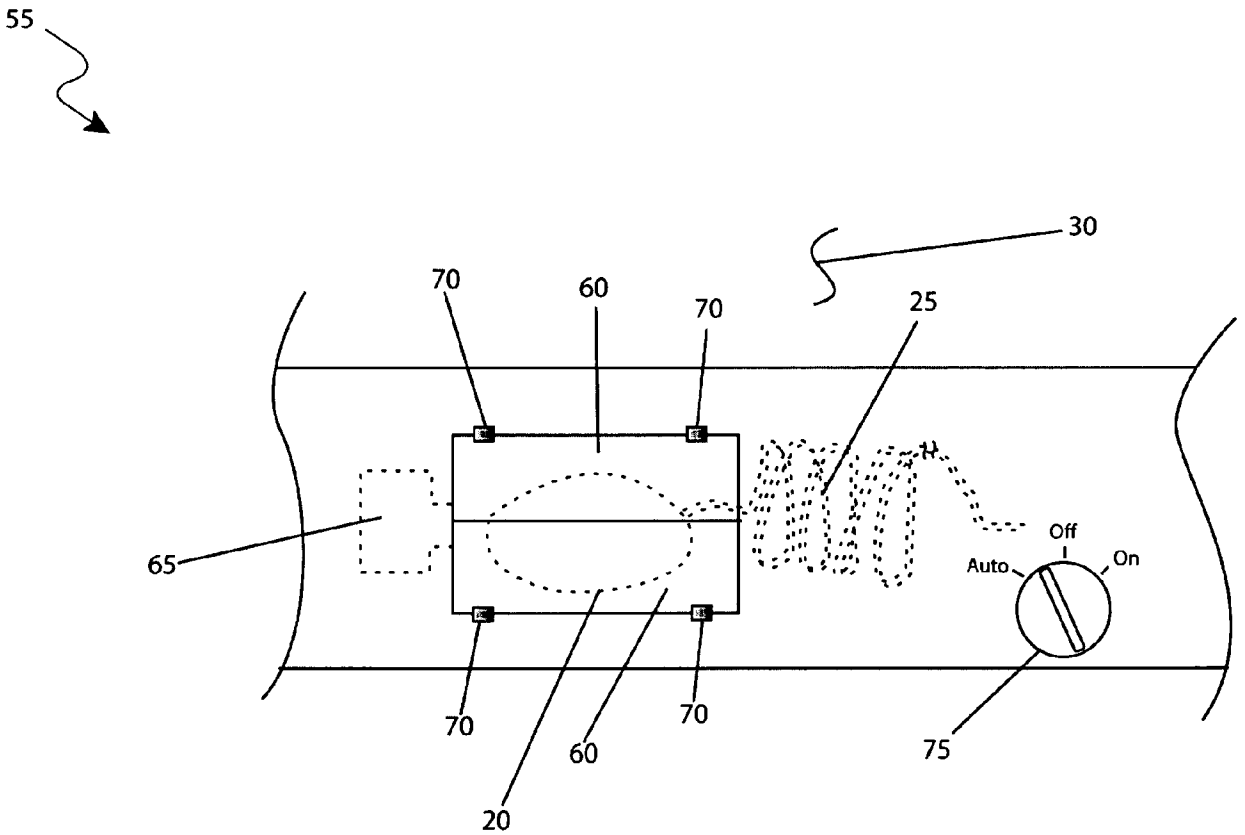
FIG. 3 is a sectional view of a central channel enclosure 55 as seen along a line I-I, as seen in FIG. 1, according to the preferred embodiment of the present invention.
Figure 4:
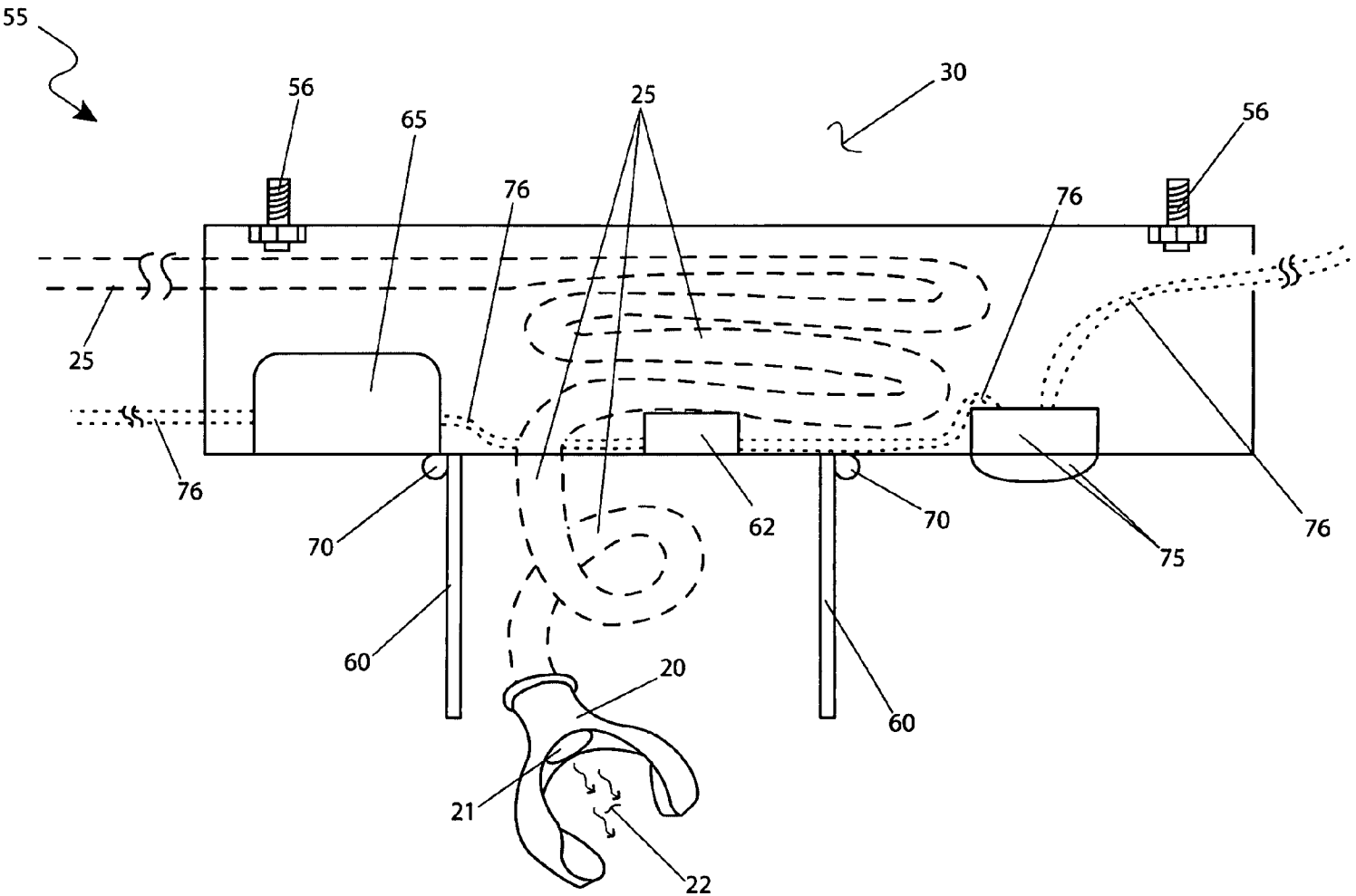
FIG. 4 is a front view of the central channel enclosure 55 depicting a deployed state, according to the preferred embodiment of the present invention.

Referring now to FIGS. 2 through 4, various views of the central channel enclosure 55, according to the preferred embodiment of the present invention, are disclosed. FIG. 2 depicts an environmental view of the central channel enclosure 55 depicting a deployed state, FIG. 3 depicts, a sectional view of the central channel enclosure 55 as seen along a line I-I therein FIG. 1, and FIG. 4 depicts a front view of the central channel enclosure 55. These figures more clearly depict the view of the underside of the roof 30 as seen by the occupants 120. The components of the system 10 would be housed in a rectangular central channel enclosure 55 that would run on the underside of the roof 30 in an overhead console configuration, similar to the mask dispensing system as found on commercial airlines that is automatically deployed as a result of airplane cabin de-pressurization. Said central channel enclosure 55 is preferably fastened to the interior roof portion 30 therewith an appropriate amount of enclosure fasteners 56. Said enclosure. fasteners 56 are conventional screws, nuts and bolts, or the like.

The system 10 comprises a pair of spring-loaded doors 60 thereon each central channel enclosure 55. Each spring-loaded door 60 is fabricated from a ferrous metal material, thereby securing to a common magnet 62. Said magnet 62 is located on a lower portion of the central channel enclosure 55 intermediately positioned between each door 60. Each spring-loaded door 60 automatically opens via an electromagnet release mechanism 65.

The electromagnet release mechanism 65 is interconnected to the magnet 62 and a control switch 75 (discussed in further detail herein below) therewith electrical wiring 76, thereby allowing for communication of the position of the control switch 75 to the electromagnet release mechanism 65 to deploy the spring-loaded doors 60. When the control switch 75 is positioned to an "ON" position current is directed to the electromagnet release mechanism 65 to demagnetize the magnet 62 and open the spring-loaded doors 60. When the control switch 75 is positioned to the "AUTO" the electromagnet release mechanism 65 is controlled via a moisture detection switch 105 (not shown) location near the tank 41. Said moisture detection switch 105 senses that the vehicle 15 has been submerged in water and sends a signal to the electromagnet release mechanism 65 to demagnetize the magnet 62 and open the spring-loaded doors 60. The spring-loaded doors 60 are supported by an appropriate amount of conventional hinges 70, as shown, located thereon the outer edge of each spring-loaded doors 60. When opened, the individual breathing masks 20 will release downwardly via gravity and be ready for use.

Also located on a surface of the central channel enclosure 55 is a control switch 75. Said control switch 75 is preferably a digit-operated multi-position switch, yet other switching means may be incorporated without limiting the functions of the system 10. In its normal position, it would be left in the "AUTO" position where the deployment of the breathing mask 20 is controlled by an array of independent sensors as will be described in greater detail herein below. In the "OFF" position, the system 10 will be disabled and will not deploy in that seating position under any situation. Such a setting would be desired for maintenance work, long term storage, use with infant seats and the like. In the "ON" position, the breathing mask 20 will be deployed immediately. Such a position would be used should the use of the gaseous mixture 22 be needed immediately for a medical situation. The use of an individual control switch 75 for each seating position allows for individual control, rather than one (1) switch that would release all of the breathing masks 20 and waste the gaseous mixture 22 when only one (1) would be needed for the purported example of a medical emergency. The central channel enclosure 55 would be specifically designed for each type and style of motor vehicle such that it would match and fit with the profile of the roof 30.

The breathing mask 20 is similar to conventional scuba diving mouthpieces. Said breathing mask 20 is inserted into an occupants 120 mouth and secured by said occupant 120 biting downwardly thereon, thereby allowing the breathable gaseous mixture 22 to be directed thereinto the occupants 120 lungs. The coiled flexible tubing 25 is connected to an end portion of the breathing masks 20 preferably via an interference fitting means, yet other fitting means may be provided without limiting the functions of the system 10. Said connection enables the breathable gaseous mixture 22 to be directed through an aperture 21 in the breathing mask 20 and outwardly for utilization by an occupant 120.

Figure 5:
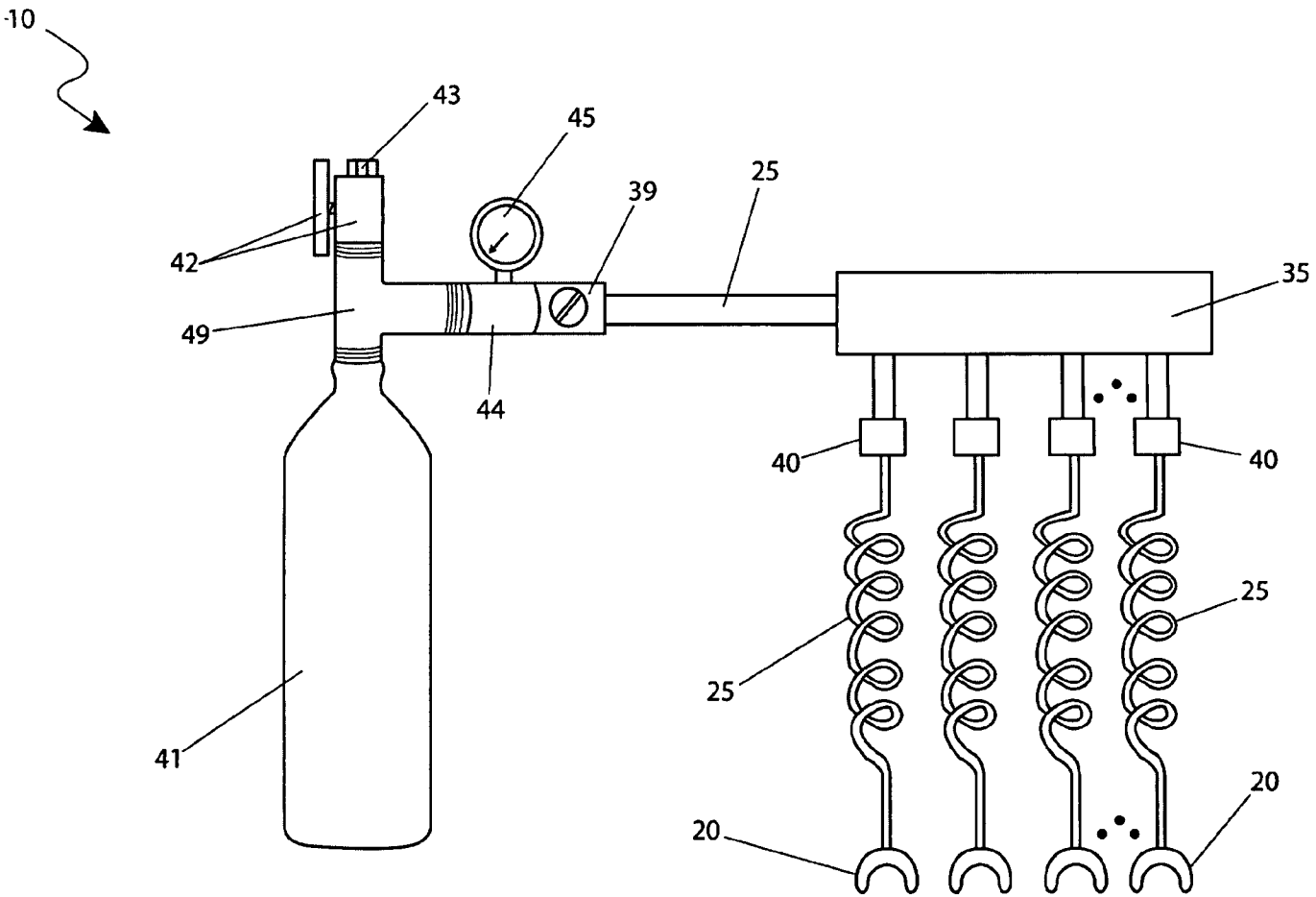
FIG. 5 is a mechanical riser diagram depicting the mechanical components of the self-contained breathing system for motor vehicles 10, according to the preferred embodiment of the present invention.

Referring now to FIG. 5, a mechanical riser diagram depicting the mechanical components of the system 10, according to the preferred embodiment of the present invention, is disclosed. The tank 41 is fitted with a conventional T-fitting 49 located thereon a distal upper portion, thereby enabling connection to the manifold 35 via conventional valves. A gate valve 42 provides a secondary valve means preferably of the manual variety. A main pressure gauge 45 is provided local to the motor vehicle 15 so as to allow the determination of the fill status of the tank 41. Said main pressure gauge is also connected to a conventional regulator 44. Should the tank 41 require refilling, a separate Schrader valve 43 provides a fill port means which allows refilling from multiple sources, such as from a compressor, central tank, or the like. A conventional ball valve 29 provides a manual output shutoff valve which is mechanically interconnected to the manifold 35 where pressure and flow can be equalized between the various coiled flexible tubing 25 and breathing mask 20. The physical connection between the manifold 35 and the coiled flexible tubing 25 is controlled by the solenoid valves 40. The solenoid valves 40 are electrically operated by the application of 12 VDC from the electrical distribution system of the motor, vehicle 15. Thus, the only electrical component as involved in the mechanical system of the system 10 is the solenoid valves 40 and as such, provides for the maximum reliability.

Figure 6:
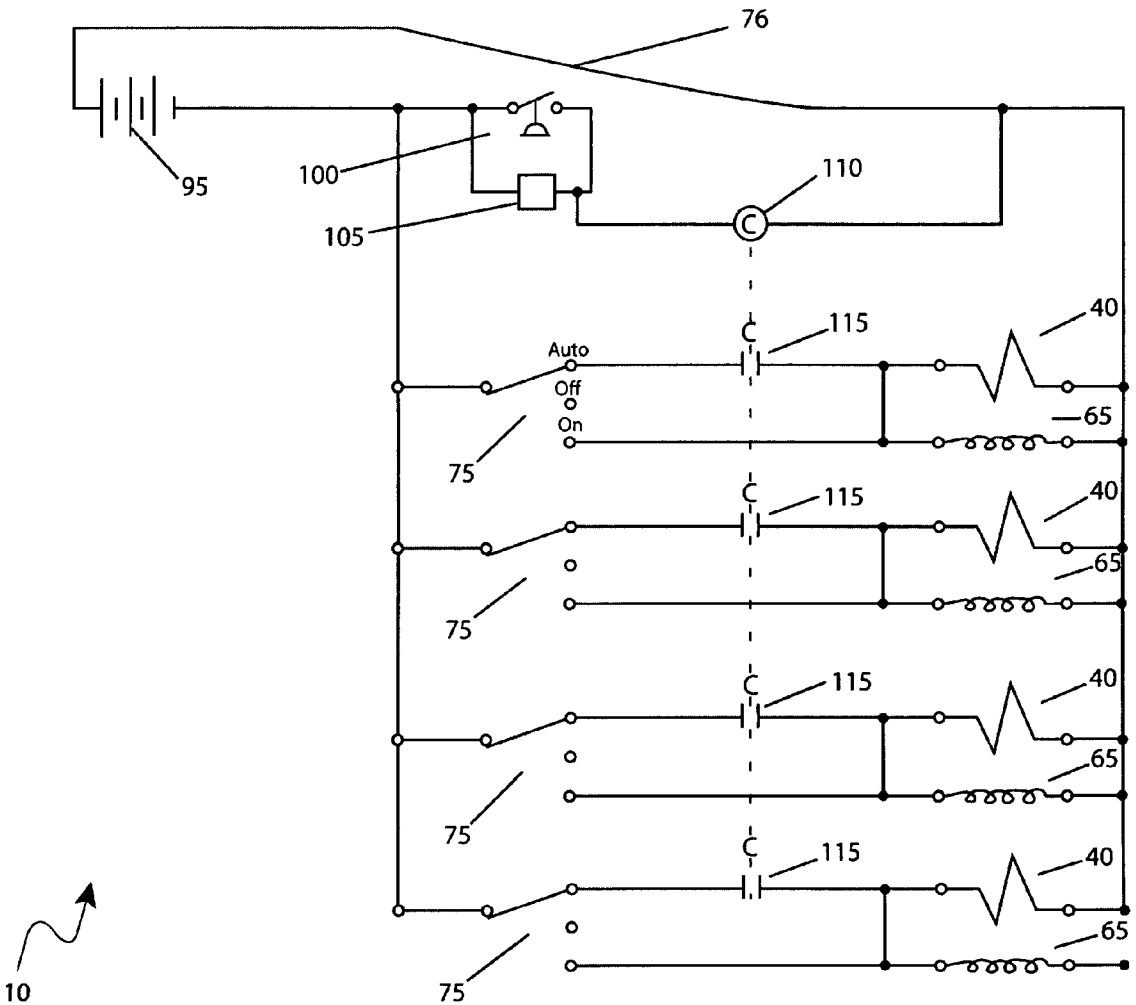
FIG. 6 is an electrical block diagram disclosing the major electrical components as used with the self-contained breathing system for motor vehicles 10, according to the preferred embodiment of the present invention.

Referring now to FIG. 6, an electrical block diagram depicting the electrical components as used with the system 10, according to the preferred embodiment of the present invention, is disclosed. Power for the system 10 is derived from a battery 95 as provided via the motor vehicle 15. Power is then routed from the battery 95 to a pressure switch 100 and the moisture detection switch 105 wired in a parallel configuration. The pressure switch 100 will sense internal pressure of the passenger compartment of the motor vehicle 15 and switch to a closed state in the event of increased ambient pressure due to submersion of the motor vehicle 15 under water. The moisture detection switch 105 will function in the same manner but will close upon the detection of water. The parallel configuration allows either the pressure switch 100 or the moisture detection switch 105 to close the circuit, thus providing redundancy and increased protection. The electric current then flows from the pressure switch 100 and/or the relay contacts 115 to a relay coil 110. The pressure switch 100 is provided with a series of multiple relay contacts 115 which correspond to the number of seating positions in the motor vehicle 15. The relay contacts 115 are located in the "AUTO" wiring position of the control switch 75 for each seating position. Thus, should the control switch 75 be in the "AUTO" position, and the relay contacts 115 be closed, electrical power will flow to both the solenoid valves 40 and the electromagnet release mechanism 65. In such a manner, the spring-loaded doors 60 (as shown in FIGS. 2 through 4) will open, and the breathing mask 20 along with the coiled flexible tubing 25 (as shown in FIGS. 1 and 2) will descend downwardly and be pressurized for use by the solenoid valves 40.

As such, it can be easily seen that all breathing mask 20 will be released as long as all control switch 75 are placed in the "AUTO" position. Should just one (1) of the breathing mask 20 be required for a medical reason, the corresponding control switch 75 will be placed in the "ON" position thus bypassing the relay contacts 115 and allowing for immediate use of only the one (1) desired breathing mask 20 and coiled flexible tubing 25.

Referring now to FIG. 7, a front view of the tank 41 and FIG. 8 a bottom view of the tank 41, according to the preferred embodiment, are disclosed. The system 10 comprises a conventional cylindrical tank 41, thereby providing a means to house and transport the breathable gaseous mixture 22. Said tank 41 is secured therein the vehicle 15 therewith a pair of conventional actuating brackets 46, thereby restraining the tank 41 from damage as a result of rough travel. One (1) bracket 46 is positioned thereon an upper portion of the tank 41 and another bracket 46 is positioned thereon a lower portion of the tank 41. Each bracket 46 is fabricated from a metal material and secured to the vehicle via conventional fasteners 47 such as, but not limited to: screws, nuts and bolts, or the like. Each bracket 46 is secured with a pair of fasteners 47, one (1) at each end portion.

An upper portion of the tank 41 is fitted with a conventional t-fitting 49, thereby further providing a connection means to the gate valve 42, the Schrader valve 43, and the regulator 44. As mentioned above the gate valve 42 provides a manual secondary valve to assure against long-term leakage. Said gate valve 42 is connected to the T-fitting via a threading means and is further connected to a conventional Schrader valve 43 via threading means. Said Schrader valve 43 provides a means to refill the tank 41 similar to tires thereon motor vehicles 15 or bicycles. The T-fitting 49 is also connected to a conventional piston-type or diaphragm-type regulator 44 which is further connected to a conventional air pressure gauge 45. The regulator 44 enables the gaseous mixture 22 to expel from the tank 41 in a controlled manner and the gauge 45 monitors the pressure of the gaseous mixture 22 contained within the tank 41. Connected to an end portion of the regulator 44 is a conventional ball valve 39 which provides a shut-off means to the gaseous mixture 22. Said ball valve 39 is utilized for maintenance purposes thereto cease the supply of the gaseous mixture 22 from beyond said ball valve 39.

It is envisioned that other styles and configurations of the present invention can be easily incorporated into the teachings of the present invention, and only one (1) particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIGS. 1 through 8.

The method of installing and utilizing the system 10 may be achieved by performing the following steps: acquiring the system 10; installing the central channel enclosure 55 at a desired location; routing the coiled flexible tubing 25 throughout the vehicle 15; connecting the breathing masks 20 to the tubing 25; charging the tank 41 with a breathable gaseous mixture 22, thereby closing the ball valve 39, opening the gate valve 42 and refilling the tank 41 through the Schrader valve 43 or replacing with a pre-filled and/or pressurized unit; fastening the tank 41 to a desired location in the vehicle 15 therewith a pair of brackets 46 and fasteners 47; connecting the solenoid valves 40 to the manifold 35, if not previously installed; connecting the tank 41 to the manifold 35; connecting the coiled flexible tubing 25 to the solenoid valves 40; ensuring that the ball valve 39 is in an open state; switching the control switch 75 for each seating position to the appropriate position; and, utilizing the system 10 as necessary.

Utilization of the system 10 occurs in two different situations corresponding to the two different settings of the respective control switch 75. The first situation would occur when the control switch 75 is in the "AUTO" position and the system 10 may be achieved by performing the following steps: activating the system 10 would occur when the motor vehicle 15 falls into or is being driven into a body of water and becoming submerged; allowing the pressure switch 100 and/or the moisture detection switch 105 will activate and close, thus energizing the relay coil 110 and closing the relay contacts 115; allowing the electromagnet release mechanism 65 to release the spring-loaded doors 60 and allow the breathing mask 20 and coiled flexible tubing 25 to be released via gravity; allowing the relay contacts 115 to energize and open the respective solenoid valves 40 thus allowing pressurized air/oxygen to flow to the breathing mask 20; placing and securing the breathing mask 20 to the occupants 120 face; waiting for rescue or continuing to escape; and, being alive due to the system 10.

The second situation would occur when the control switch 75 would be placed in the "ON" position and the system 10 may be achieved by performing the following steps: releasing the breathing mask 20 as well as subsequent air/oxygen flow would follow the same methodology as described above; breathing-in the air/oxygen through the breathing mask 20; switching the control switch 75 to either the "OFF" or "AUTO" position when the need for an air/oxygen mixture no longer exists; stowing the breathing mask 20 and coiled flexible tubing 25 within the central channel enclosure 55; utilizing when necessary; and, recharging or replacing the tank 41 to ensure that a complete operating cycle is available should it be needed at a later date.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A motor vehicle self-contained breathing system for supplying a gaseous mixture to occupants of the motor vehicle during submersion of the motor vehicle, said motor vehicle self contained breathing system comprising:

a plurality of breathing masks adapted to be positioned within the motor vehicle;

a plurality of flexible tubing in fluid communication with said breathing masks;

a manifold in fluid communication with said tubing;

a plurality of valves intermediately coupled to said manifold and said tubing;

a tank adapted to release the gaseous mixture;

a plurality of central channel enclosures connected to said manifold and located downstream therefrom;

a plurality of electromagnet release mechanisms operably coupled to said central channel enclosures for releasing said tubing and said breathing masks from said central channel enclosures respectively when moisture is detected in the motor vehicle;

a control switch communicatively coupled to said electromagnet release mechanisms;

wherein each of said central channel enclosures comprises:

a plurality of spring-loaded doors;

a magnet intermediately positioned between each door; and, a control switch communicatively coupled to said magnet;

wherein a corresponding one of said electromagnet release mechanisms is interconnected to one (1) of said magnets and one of said control switches in such a manner that a corresponding one (1) of said spring-loaded doors is deployed when said one (1) magnet is demagnetized;

a plurality of moisture detection switches adapted to sense whether the motor vehicle has been submerged in water, each of said moisture detection switches sending a signal to a corresponding one (1) of said electromagnet release mechanisms and thereby demagnetizing a corresponding one (1) of said magnets for opening a corresponding one (1) of said spring-loaded doors; and, a manual output shutoff valve mechanically interconnected to said manifold for equalizing air pressure in said tubing and said breathing masks;

wherein one of said flexible tubing is directly coupled to said manifold and said manual output shutoff valve, respectively.

2. The motor vehicle self-contained breathing system of claim wherein said control switches are manually actuated.

3. The motor vehicle self-contained breathing system of claim further comprising:

a T-fitting connected to said tank;

a gate valve coupled to a top end of said T-fitting;

a pressure gauge connected to said tank;

a regulator connected to said pressure gauge; and, a refill valve connected to said gate valve.

4. The motor vehicle self-contained breathing system of claim further comprising:

a power source; and, a pressure switch electrically coupled to said power source, wherein said pressure switch is adapted to sense an internal pressure of a passenger compartment of the motor vehicle and thereby transmit power to said control switch for toggling said spring-loaded doors between open and closed positions.

5. A motor vehicle self-contained breathing system for supplying a gaseous mixture to occupants of the motor vehicle during submersion of the motor vehicle, said motor vehicle self contained breathing system comprising:

a plurality of breathing masks adapted to be positioned within the motor vehicle;

a plurality of flexible tubing in fluid communication with said breathing masks, wherein said flexible tubing includes a first tubing and a group of second tubing spaced therefrom;

a manifold in fluid communication with said each of said first tubing and said group of second tubing;

a plurality of valves intermediately coupled directly to said manifold and said group of second tubing;

a tank adapted to release the gaseous mixture;

a plurality of central channel enclosures connected to said manifold and located downstream therefrom;

a plurality of electromagnet release mechanisms operably coupled to said central channel enclosures for releasing said group of second tubing and said breathing masks from said central channel enclosures respectively when moisture is detected in the motor vehicle; and, a control switch communicatively coupled to said electromagnet release mechanisms;

wherein said breathing masks and said group of second tubing are automatically deployed upon communication from said electromagnet release mechanisms respectively;

wherein each of said central channel enclosures comprises:

a plurality of spring-loaded doors;

a magnet intermediately positioned between each door; and, a control switch communicatively coupled to said magnet;

wherein a corresponding one of said electromagnet release mechanisms is interconnected to one (1) of said magnets and one of said control switches in such a manner that a corresponding one (1) of said spring-loaded doors is deployed when said one (1) magnet is demagnetized;

a plurality of moisture detection switches adapted to sense whether the motor vehicle has been submerged in water, each of said moisture detection switches sending a signal to a corresponding one (1) of said electromagnet release mechanisms and thereby demagnetizing a corresponding one (1) of said magnets for opening a corresponding one (1) of said spring-loaded doors; and a manual output shutoff valve mechanically interconnected to said manifold for equalizing air pressure in said group of second tubing and said breathing masks;

wherein said first tubing has a proximal end directly coupled to said manual output shutoff valve;

wherein said first tubing has a distal end directly coupled to said manifold;

wherein each said tubing of said group of second tubing has a proximal end directly coupled to a corresponding one of said valves;

wherein each said tubing of said group of second tubing has a distal end directly coupled to a corresponding one of said breathing masks;

wherein each said tubing of said group of second tubing ingresses through a first wall of a corresponding one of said central channel enclosures and egresses from a second wall of said corresponding one of said central channel enclosures; and, wherein said first tubing is disposed upstream of said central channel enclosures.

6. The motor vehicle self-contained breathing system of claim 5, wherein said control switches are manually actuated.

7. The motor vehicle self-contained breathing system of claim 5, further comprising:

a T-fitting connected to said tank;

a gate valve coupled to a top end of said T-fitting;

a pressure gauge connected to said tank;

a regulator connected to said pressure gauge; and, a refill valve connected to said gate valve.

8. The motor vehicle self-contained breathing system of claim 5, further comprising:

a power source; and, a pressure switch electrically coupled to said power source, wherein said pressure switch is adapted to sense an internal pressure of a passenger compartment of the motor vehicle and thereby transmit power to said control switch for toggling said spring-loaded doors between open and closed positions.

9. A method of utilizing a motor vehicle self-contained breathing system for supplying a gaseous mixture to occupants of the motor vehicle during submersion of the motor vehicle, said method comprising the steps of:

providing and installing a central channel enclosure at a desired location within the motor vehicle;

providing and routing tubing throughout the motor vehicle;

providing and connecting a plurality of breathing masks to said tubing;

providing and charging a tank with the gaseous mixture;

providing and connecting a ball valve and a gate valve to said tank respectively;

closing said ball valve and opening said gate valve;

fastening said tank to a desired location in the motor vehicle;

providing and coupling a manifold to said tank;

providing and connecting a plurality of valves to said manifold;

connecting said tubing to said valves;

providing and toggling a control switch to a desired operable position;

when the motor vehicle is submerged, automatically releasing said breathing masks and said tubing;

wherein each of said central channel enclosures comprises:

a plurality of spring-loaded doors;

a magnet intermediately positioned between each door; and, a control switch communicatively coupled to said magnet;

wherein a corresponding one of said electromagnet release mechanisms is interconnected to one (1) of said magnets and one of said control switches in such a manner that a corresponding one (1) of said spring-loaded doors is deployed when said one (1) magnet is demagnetized;

providing a plurality of moisture detection switches adapted to sense whether the motor vehicle has been submerged in water, each of said moisture detection switches sending a signal to a corresponding one (1) of said electromagnet release mechanisms and thereby demagnetizing a corresponding one (1) of said magnets for opening a corresponding one (1) of said spring-loaded doors;

providing and mechanically interconnecting a manual output shutoff valve to said manifold for equalizing air pressure in said tubing and said breathing masks; and directly coupling one of said flexible tubing to said manifold and said manual output shutoff valve, respectively.

* * * * *